US011234539B2

(12) United States Patent
Black

(10) Patent No.: US 11,234,539 B2
(45) Date of Patent: Feb. 1, 2022

(54) ADJUSTABLE PICTURE HANGING AND HOOK SYSTEM

(71) Applicant: Parnell Black, Huntington Beach, CA (US)

(72) Inventor: Parnell Black, Huntington Beach, CA (US)

( * ) Notice: Subject to any disclaimer, the term of this patent is extended or adjusted under 35 U.S.C. 154(b) by 0 days.

(21) Appl. No.: 15/423,307

(22) Filed: Feb. 2, 2017

(65) Prior Publication Data

US 2020/0196779 A1 Jun. 25, 2020

(51) Int. Cl.
*A47G 1/20* (2006.01)
*A47G 1/16* (2006.01)

(52) U.S. Cl.
CPC ..... *A47G 1/20* (2013.01); *A47G 1/1686* (2013.01)

(58) Field of Classification Search
CPC . A47G 1/22; A47G 1/20; A47G 1/205; A47G 1/202
See application file for complete search history.

(56) References Cited

U.S. PATENT DOCUMENTS 3,232,572 A * 2/1966 Ekstrom ..... F16B 45/00 248/217.2
3,330,525 A * 7/1967 Weinstein ..... A47G 1/202 248/496
5,346,169 A * 9/1994 Polonsky ..... A47G 1/20 248/224.7
5,542,641 A * 8/1996 Donovan ..... A47G 1/1646 248/262
6,042,078 A * 3/2000 Donovan ..... A47G 1/205 248/489
7,578,492 B2 * 8/2009 Darre' ..... B25H 3/006 248/217.4
7,665,705 B2 * 2/2010 Wong ..... A47G 1/20 248/489
8,844,886 B2 * 9/2014 Mejia ..... A47G 1/20 248/216.4
10,047,903 B2 * 8/2018 Bruno ..... B25C 3/008
10,070,740 B2 * 9/2018 Jacobs ..... A47G 1/202
2005/0087668 A1 * 4/2005 Cismoski ..... A47G 1/205 248/489
2010/0294910 A1 * 11/2010 Orsini ..... A47G 1/20 248/475.1
2011/0085874 A1 * 4/2011 Davidowitch ..... F16B 15/0053 411/82.1
2012/0241583 A1 * 9/2012 Potgieter ..... A47G 1/202 248/475.1
2016/0338511 A1 * 11/2016 Turner ..... A47G 1/205
2018/0073549 A1 * 3/2018 Cogburn ..... F16M 13/02
2019/0133347 A1 * 5/2019 Kirschhoffer ..... A47G 1/20

* cited by examiner

*Primary Examiner* — Bradley Duckworth

(57) ABSTRACT

This invention provides a hanger for supporting pictures, mirrors or other objects on a wall. Specifically, this invention allows a person to nail the hanger to the wall and if relatively minor adjustments are needed, to remove a screw cap on the nail, remove the hanger and reattach the hanger to the wall using another hole on the hanger that best approximates the desired position, then put the cap back on the nail and screw the cap tight. In another embodiment, spacers can be attached to the hanger so that additional hangers can form a larger hanger and then placed back on the wall through the nail already in place that best approximates the position. Additional nails can then be inserted into some of the other hanger's holes to provide additional support, strength and leveling.

8 Claims, 7 Drawing Sheets

ADJUSTABLE PICTURE HANGING AND HOOK SYSTEM

BACKGROUND OF THE INVENTION

1. Field of the Invention

This invention provides a picture hanging and hook system. Specifically, this invention provides a picture hanger whose position can be adjusted once the first nail is driven into the wall and an individual realizes that the hanger is off center without removing the nail.

2. Related Art

A large number of patents have been issued encompassing picture hangers. Typically, picture hangers are stamped from sheet metal and during the manufacturing process, one end of the stamped metal is turned up to form a hook. A nail is used to attach the hanger to a wall by driving the nail through a hole in the hanger. A wire or ring attached to a picture or object can connect with the hook on the hanger so that the picture or object can remain hanging on the wall by the force of gravity. When a force is applied upward to the bottom of the picture or object, the wire or ring on the picture or object disengages with the hook on the hanger so that the picture or object can be removed from the wall.

However, when the hanger is placed on the wall, more often than not, the hanger is not placed in the correct location for the picture or object. In these instances, the hanger and nail have to be removed from the wall and repositioned. Thus, a need exists for a hanger that can be repositioned without removing the nail from the wall.

SUMMARY

This invention provides a hanger for supporting pictures, mirrors or other objects on a wall. Specifically, this invention allows a person to nail the hanger to the wall where the nail is inserted through a "central" hole in the hanger, though the hanger has multiple holes. If relatively minor up or down adjustments are needed to reposition the picture, mirror or other object on the wall a person can remove a screw cap on the nail, remove the hanger and reinsert the nail in another hole on the hanger that best approximates the position, then put the cap back on the nail and screw the cap tight. If needed or desired, additional nails can then be inserted into the other holes in the hanger to provide additional weight support.

In another embodiment, this invention allows a person to nail the hanger to the wall and if adjustments are needed where left or right picture centering is desired, the screw cap on the nail can be removed, using spacers inserted between and attached to one or more hangers, the hanger can be placed back on the wall through the nail hole that best approximates the position. The cap can be screwed back on the nail and tightened. Additional nails can then be inserted into some of the other holes in the hanger to provide additional support for weight and/or leveling. The spacers allow for the repositioning of the hanger if left or right adjustments need to be made to the hanger's desired location.

Other systems, methods, features, and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DETAILED DESCRIPTION OF THE DRAWINGS

The components in the figures are not necessarily to scale, emphasis being placed instead upon illustrating the principles of the invention. In the figures, like reference numerals designate corresponding parts throughout the different views.

DETAILED DESCRIPTION

Figure 1:
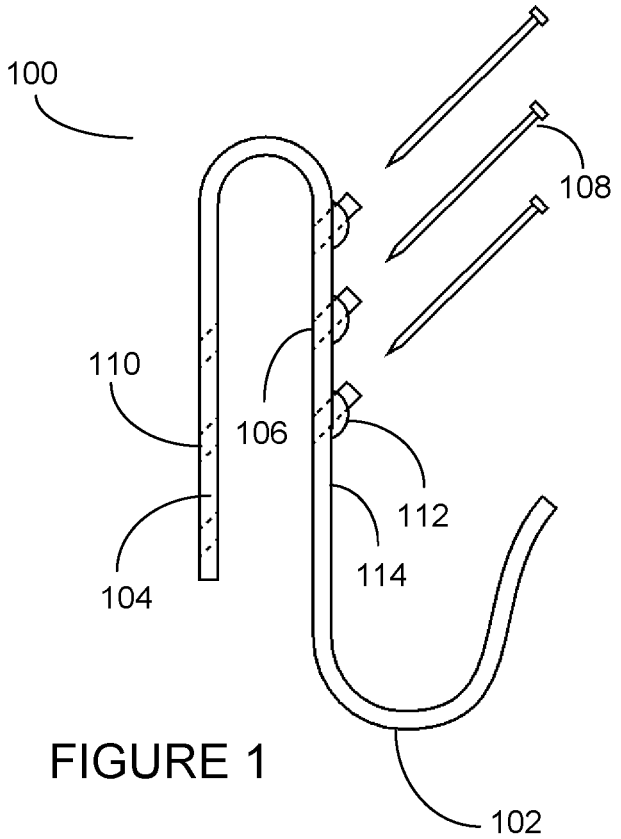
FIG. 1 is a side view of a hook system for hanging pictures, mirrors and other objects on walls.

FIG. 1 is a side view of a hook system for hanging pictures, mirrors and other objects on walls. A hook system 100 can be formed from a bent piece of metal or from an injected molded plastic material. The hook 102 can be formed so that it forms a catch of a wire attached to a picture frame, mirror or object. In the alternative, the hook 102 can attach to a fixed hoop or loop member that is attached to a picture frame, mirror or some other object such that the fixed hoop or loop can engage the hook 102 such that the picture frame, mirror or object hangs on a wall. In this embodiment, the hook 102 has its opposite end 104 folded over on itself as shown in FIG. 1.

In such a configuration, three openings 106 can be angled (see dotted lines) so that at least one nail 108 can slide through a center opening 106 at an angle so that the sharp end of the nail 106 can pass through the openings 106 and enter through a second opening 110 to which the first opening aligns. A reinforced area 112 could be formed around the first opening 106 increasing the carrying load of the hook 102. The hook system 100 can attach to a wall with at least one nail entering at an angle. The distance separating the shank 114 from the folded over section 104 can be a short distance as shown in FIG. 1 or adjacent to each other with very little distance between to the sections. FIG. 1 shows one embodiment of the hook system 100 where the metal is bent in reversed "S" shape. Other embodiments may include the hook system 100 formed where the metal is bent in an "e" shape where one end of the metal forms a closed or nearly closed loop forming the closed section of the letter "s" or "e". In these other embodiments formed in a shape of a low case letter "s" or "e", nail holes could be formed in the metal.

Figure 2:
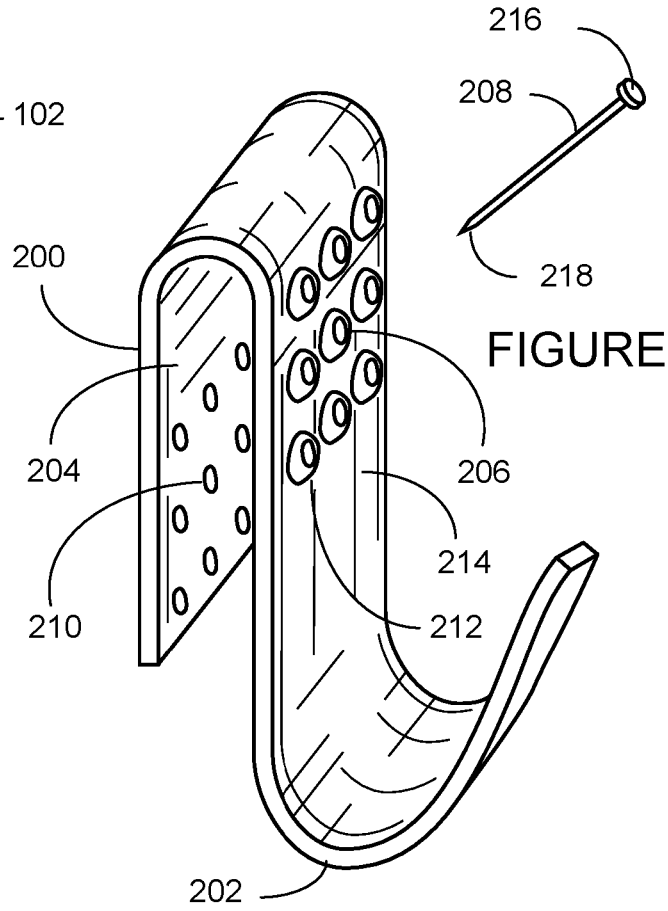
FIG. 2 is a perspective view of a hanger system for hanging pictures, mirrors and other objects on walls.

FIG. 2 is a perspective view of a hook system for hanging pictures and objects. In FIG. 2, the hook system 200 can also be formed from a bent piece of metal or from an injected molded plastic material. The hook 202 can be formed from so that it forms a catch of a wire attached to a picture, mirror or object frame or a loop member attached to a picture, mirror or some other object for hanging on a wall. In this embodiment, the hook 202 has its opposite end 204 folded over on itself as shown in FIG. 2.

In this configuration, nine openings 206 can be angled (see dotted lines) so that at least one nail 208 can slide through a center opening 206 at an angle so that the sharp end of the nail 218 can pass through the center opening 206 and enter through a second opening 210. A reinforced area 212 could be formed around the first opening 206 so that the hook system 200 can attach to a wall with at least one nail entering at an angle thus increasing the carrying load of the hook 202. The distance separating the shank 214 from the folded over section 204 can be a short distance as shown in FIG. 2 or adjacent to each other with very little distance between to the sections.

When placed on a wall in the approximate area that a user seeks to hang a picture, mirror or object, the user inserts the nail 208 through the center opening 206. When aligned with the second and center opening 210, it can be angled into a wall to support a heavier load. However, when a user hangs a picture, mirror or object, more often or not, the picture is not centered in the desired area. When this happens, usually the user typically has to start over. With this invention, the nail 208 can have a screw cap 216 on the opposite end of its pointed end 218 allowing the user to remove the hanger from the wall and move it left, right, up, or down on the nail without removing the nail to reposition it to get the desired alignment before rehanging the pictures, mirror or object on the wall. When repositioning the hanger, because the nail is no longer in the center hole, it may be necessary to insert a second nail to level to level the hook on the wall before hanging.

Figure 3:
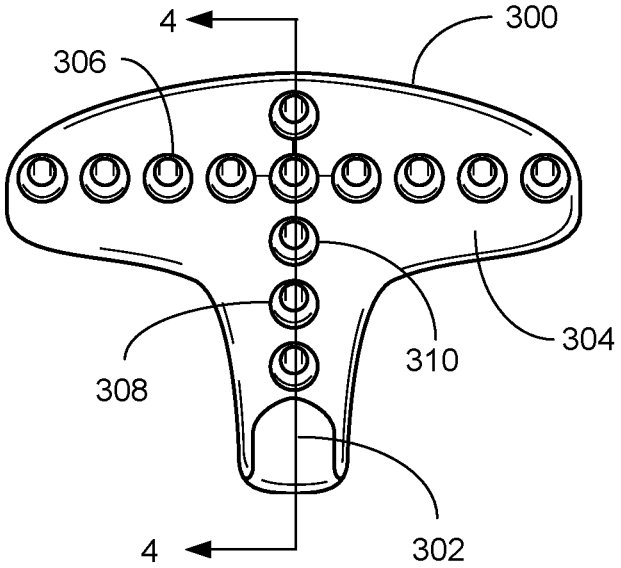
FIG. 3 is a front view of a hanger system for hanging pictures, mirrors and other objects on walls.

FIG. 3 is a front view of a hook system for hanging pictures and other objects on walls. In this embodiment, a hanger 300 has a hook 302 formed from a flat piece of metal 304 or from a flat plastic part that has been injected molded forming the hook 302. A plurality of holes are arrange in a horizontal row 306 while a second group of plurality of holes can be arranged in a vertical column 308. To hang a picture or mirror on a wall, one would typically select the middle hole in the hanger 300 and hammer a nail through the center hole 310. If the initial nail placement is off center or not placed in the exact area where the picture, mirror or other object is desired to be hung on the wall, the cap 216 of the nail 208 can be unscrewed from the nail shaft and the hanger 300 moved up or down using holes 308 to the desired location without having to remove the nail and start over. Left or right centering of the hanger system can be achieved with holes 306. Once the hanger 300 is positioned in the desired location, the cap 216 can be screwed back on the nail 208. Leveling support and stability may be necessary using additional nails inserted in selected holes in the horizontal row 306 or the vertical column 308.

Figure 4:
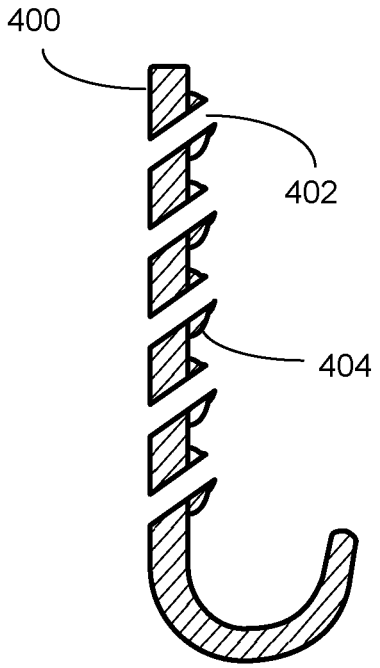
FIG. 4 is a cross sectional side view of a hanger system for hanging pictures, mirrors and other objects on walls.

FIG. 4 is a cross sectional side view of hanger and hook system 400 for hanging pictures, mirrors and other objects on walls. Just as shown in FIGS. 1-8, 11, and 14-16, the holes 402 of the hanger 400 can be reinforced with extra material 404 during the metal stamping process or extra material around the holes 404 can be added during the manufacturing process. This added material 404 provides reinforcing of the holes 402 so that the hanger 400 can support more weight and stress from the nail in the holes 402.

Figure 5:
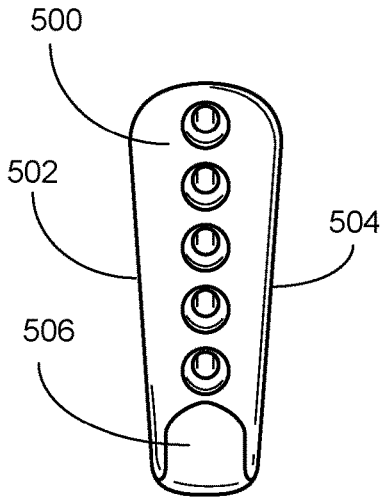
FIG. 5 is a front view of an interlocking hanger for hanging pictures, mirrors and other objects on walls.

FIG. 5 is a front view of an interlocking hook system for hanging pictures, mirrors and other objects on walls. Hanger 500 is designed to have slots along the vertical sides 502 and 504. The sides 502 and 504 can be angled inwards towards the hook 506 as shown in FIG. 5 or away from the hook with a narrow section at the top of the hook and a wider section near the hook 506. The corresponding spacer would have an opposite taper. For FIG. 5, the spacer would have a wider bottom part that tapers to a narrower upper part as shown in FIG. 6.

Figure 6:
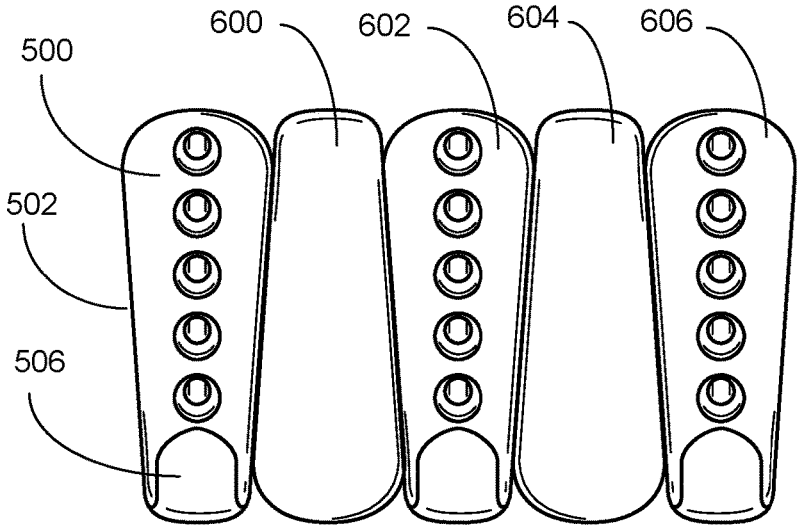
FIG. 6 is a front view of an interlocking hanger system.

FIG. 6 is a front view of an interlocking hanger system. Hanger 500 is designed to have slots along the vertical sides 502 and 504. The sides 502 and 504 are angled inwards towards the hook 506. Spacer 600 connects hanger 500 to hanger 602. Likewise, spacer 604 connects hanger 602 with hanger 606.

Figure 7:
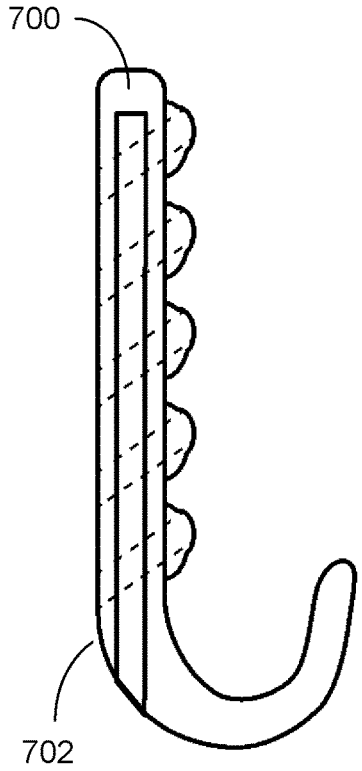
FIG. 7 is a cross sectional side view of an interlocking hanger system for hanging pictures, mirrors and other objects on walls with dotted lines illustrating the alignment of the holes.

FIG. 7 is a side view of an interlocking hook system for hanging pictures, mirrors and other objects on walls with dotted lines illustrating the alignment of the holes between the first and second opening. The hanger 700 has a slot 702 that is capable of accepting a spacer. The slot 702 can be configured to have a channel on each side 502, 504, to connect one hanger to a second hanger using a spacer in between as shown in FIG. 6. In an alternative embodiment, the hanger 700 can be formed in an "s" shape (e.g. "s" shape rotated 90 degrees) where the slot 702 is formed by bent metal forming one half of the "s" shape.

Figure 8:
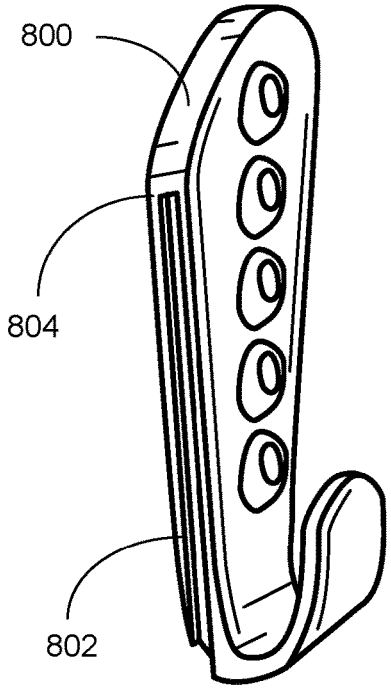
FIG. 8 is a perspective view of an interlocking hanger for hanging pictures, mirrors and other objects on walls.

FIG. 8 is a perspective view of an interlocking hanger system for hanging pictures, mirrors and other objects on walls. Hanger 800 has a slot 802 in its side for accepting a spacer (spacer not shown). This embodiment uses the weight of gravity to apply a force when the picture, mirror or other object is hung on the wall so that the weight of the object keeps the hanger and spacers interlocked. A closed end 804 acts to stop the spacer from sliding completely through the slot when the force of an object is placed on the hook. Other interlocking spacer/hanger configurations can be used to connect and attach the various spacers to the hangers.

Figure 9:
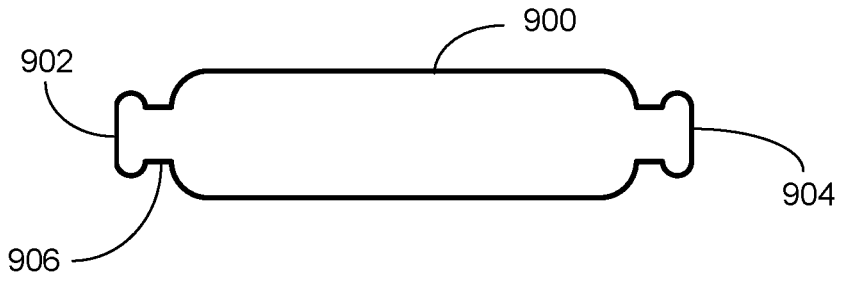
FIG. 9 is a top view of an interlocking spacer for the hanger system for hanging pictures, mirrors and other objects on walls.

FIG. 9 is a top view of a rectangular interlocking spacer system for hanging pictures, mirrors and other objects on walls. The spacer 900 depicted is generally flat shaped on top and in front and back with an interlocking shape 902, 904 that can fit within a corresponding and reciprocal shape in a rectangular hanger. In the shape of one embodiment as shown in FIG. 9, a projecting part 902 is designed with a narrowed section 906. Other shapes can include a sharp edge such as that formed by an isosceles triangle so that the base of the isosceles triangle fits snuggly in the slot in the hanger.

Figure 10:
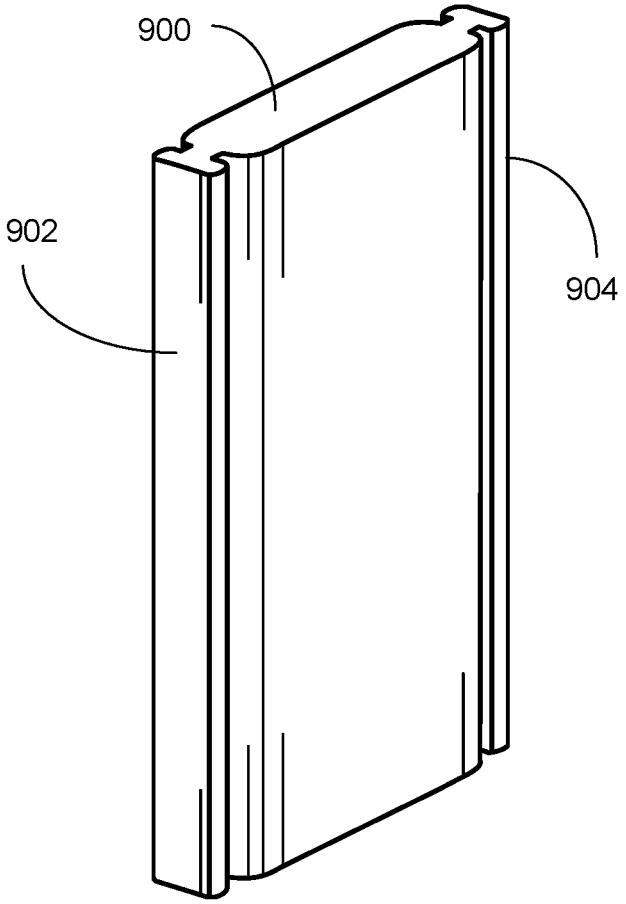
FIG. 10 is a perspective view of a rectangular spacer for a hanger system.

FIG. 10 is a perspective view of a spacer for a hanger system. The spacer 900 has two interlocking male sides are shown in FIG. 10 having an interlocking male left side 902 that can interface with a female right side of a hanger (not shown) and an interlocking male right side 904 that can interface with a female left side of a hanger (not shown). It is contemplated that the spacer 900 could have female end sides and the hanger have form fitting male sides.

Figure 11:
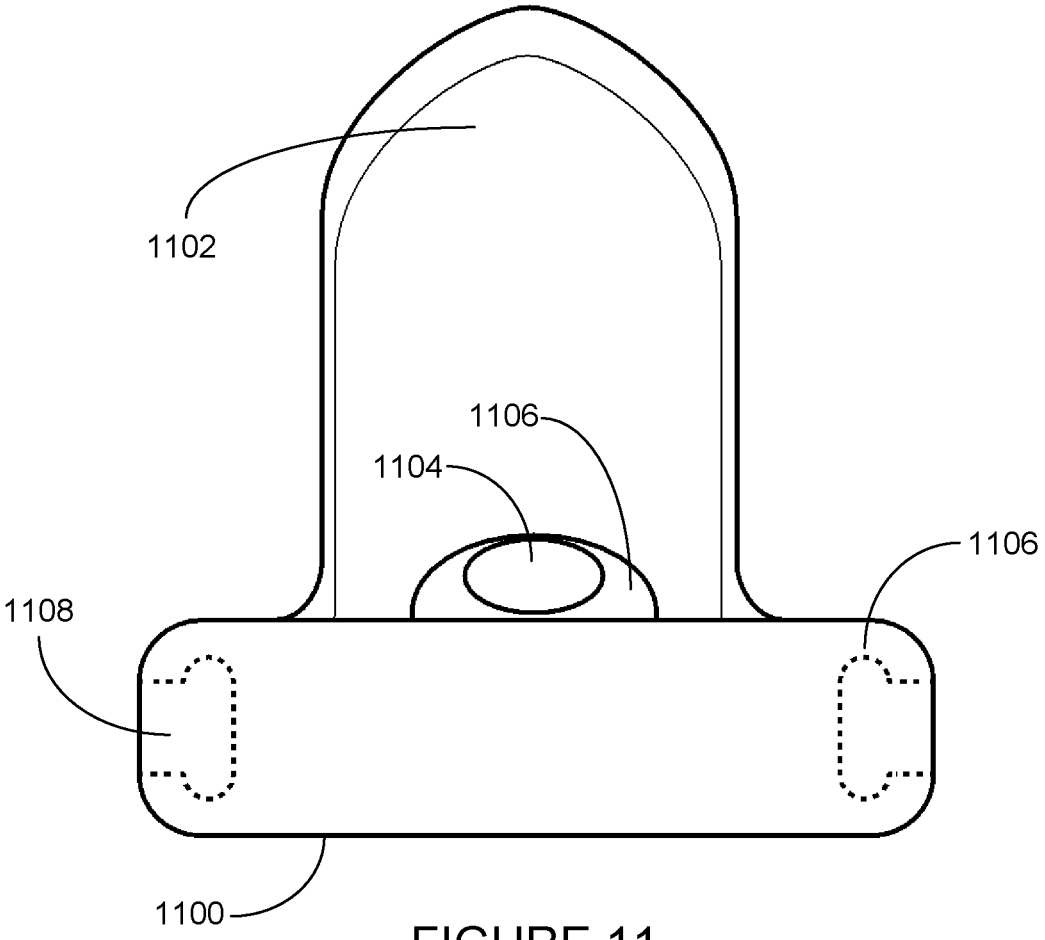
FIG. 11 is a top view of an interlocking hanger for hanging pictures, mirrors and other objects on walls.

FIG. 11 is a top view of an interlocking hanger and hook system for hanging pictures, mirrors and other objects on walls. The interlocking hanger and hook system 1100 has a hook protrusion 1102 on the bottom end. At least one nail receiving hole 1104 is positioned in the interlocking hook system 1100 and the at least one nail receiving hole 1104 may be reinforced 1106 to provide greater structural rigidity for the nail. Interlocking receptacles 1106 and 1108 allow additional interlocking members and/or spacers to be added to an adjacent interlocking hanger to provide a larger and stronger hanging system. If the first nail placed into the wall is slightly off center of the desired location, the spacers and additional interlocking hanger and hook member(s) can be repositioned on the nail without removing it, but moving the picture, mirror or object being hung on the wall to a slightly different position. Thus, allowing for a picture, mirror or object to be correctly positioned on the wall, moving it right, left, up or down. Leveling is achieved by inserting a second nail or nails in the hanger and hook system.

Figure 12:
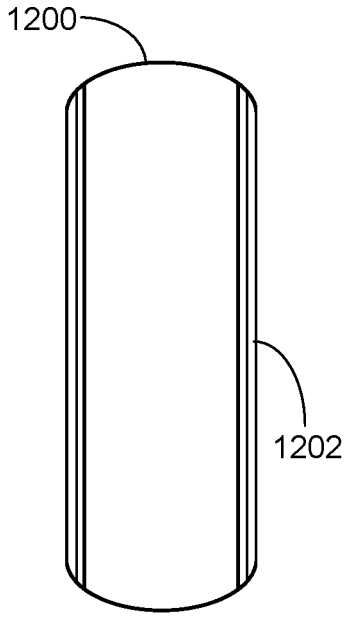
FIG. 12 is a front view of a spacer for an interlocking hanger system for hanging pictures, mirrors and other objects on walls.
Figure 13:
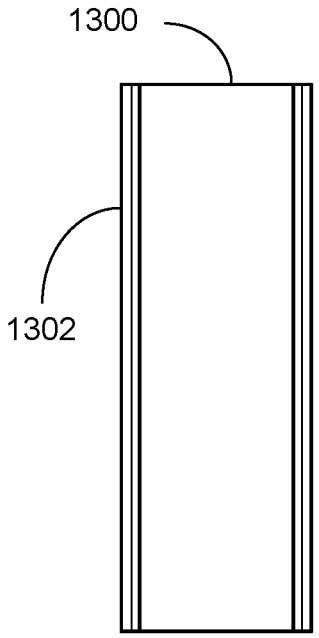
FIG. 13 is a front view of a rectangular spacer for an interlocking hanger system for hanging pictures, mirrors and other objects on walls.

FIGS. 12 and 13 are front views of spacers for an interlocking hook system for hanging pictures, mirrors and other objects on walls. In both figures, the spacers 1200 and 1300 have indentations 1202 and 1302 respectively, allowing them to slide into position in the interlocking receptacles 1106 and 1108 of a hanger as displayed in FIG. 11. FIG. 12 illustrates a spacer 1200 with rounded top and bottom ends while FIG. 13 illustrates a spacer 1300 with flat, sharp ends on the top and bottom sides.

Figure 14:
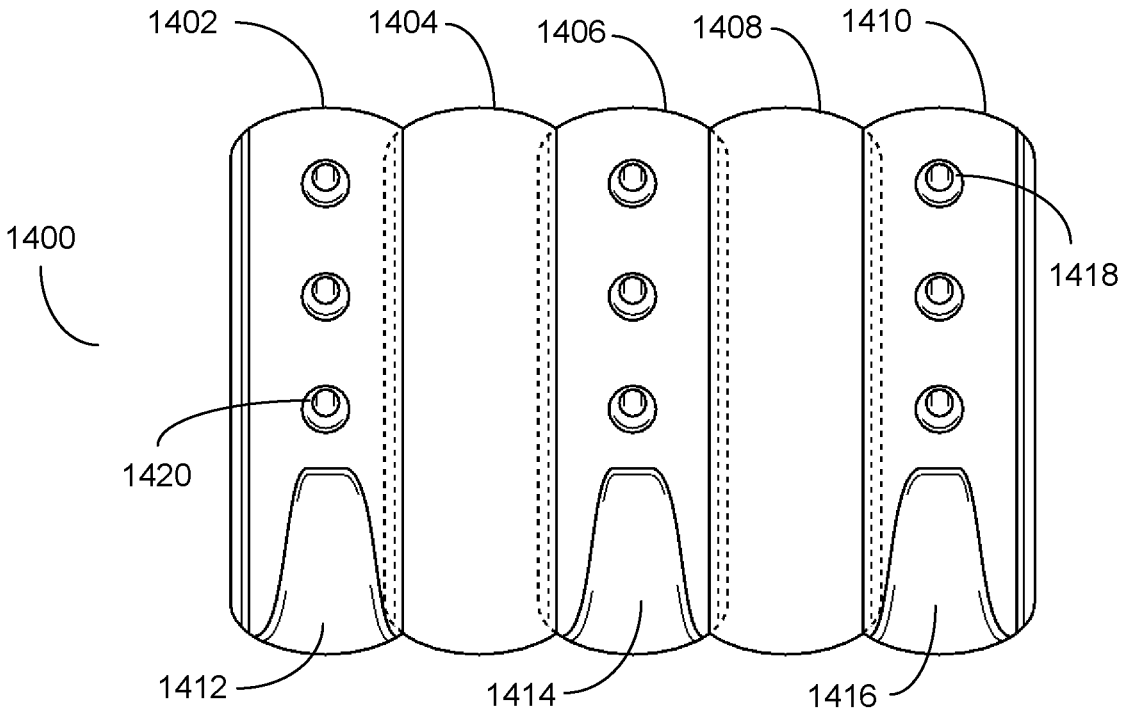
FIG. 14 is a front view of an interlocking hanger system for hanging pictures, mirrors and other objects on walls with multiple hangers connected to form the hanger system.

FIG. 14 is a front view of an interlocking hanger and spacer system 1400 for hanging pictures, mirrors and other objects on walls with multiple hangers connected with multiple spacers forming the hanging and hook system. In FIG. 14, a series of three interlocking hooks 1402, 1406 and 1410 are positioned with spacers 1404 and 1408 separating each of the three interlocking hooks 1402, 1406 and 1410. The spacers 1404 and 1408 can slide into the bottom of the interlocking hooks 1402, 1406 and 1410 and have a stopping section so that the weight of the picture or object hanging on the wall locks both the interlocking hooks with the spacers together. Hook members 1412, 1414 and 1416 can be formed on the bottom sections of the interlocking hooks 1402, 1406 and 1410 in order to catch a wire or loop that is attached to the picture, mirror or object that is being hung on the wall. Greater abilities to support heavier picture, mirror or object weights can be achieved when additional nails are driven into the openings 1418, 1420 and other unnumbered holes.

Figure 15:
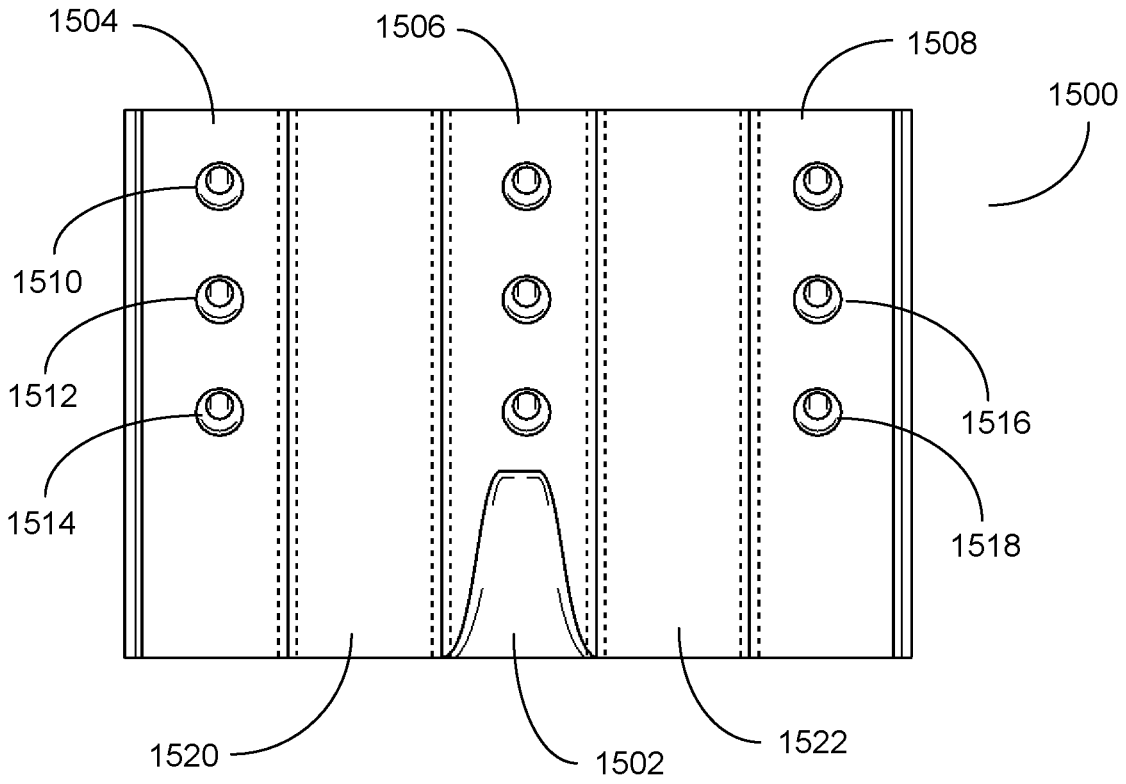
FIG. 15 is a front view of an interlocking hanger system for hanging pictures, mirrors and other objects on walls with multiple hangers connected to form the hanger system.

FIG. 15 is a front view of another embodiment of an interlocking hanger system 1500 for hanging pictures, mirrors and other objects on walls. If desired, the user or manufacturer can bend up or down so as to be bent out of the way the hooks on the hanger sections not centered to the hanger and hook system 1504, 1508, so that the picture or object is only held up by one hook as shown in FIG. 15 with hook 1502. In another embodiment, FIG. 15 illustrates where the left and right hook members have been removed leaving the center hook 1502. For added redundancy, hooks for hangers 1504, 1506 and 1508 can remain on the hanger providing added strength for holding the wire or a loop member of the picture, mirror or object.

For added stability, strength and leveling additional nails can be driven into some of the holes 1512, 1514, 1516, 1518 or the un-numbered holes as illustrated. Spacers 1520 and 1522 can connect the hangers 1504, 1506 and 1508 thus forming the hanger and hook system 1500.

The simplicity is that once the initial nail is driven into the wall, the nail cap can be unscrewed and additional interlocking hangers and spacers can be added to obtain the optimal position from the first nail. Once the desired position is achieve, the nail cap can be screwed back on the nail with the interlocking hanger and hook system in the desired position. Then additional nails can be driven into one or more of the remaining holes to provide leveling and stability, and make the overall hanger and hook system have sufficient structure to support heavy objects.

Figure 16:
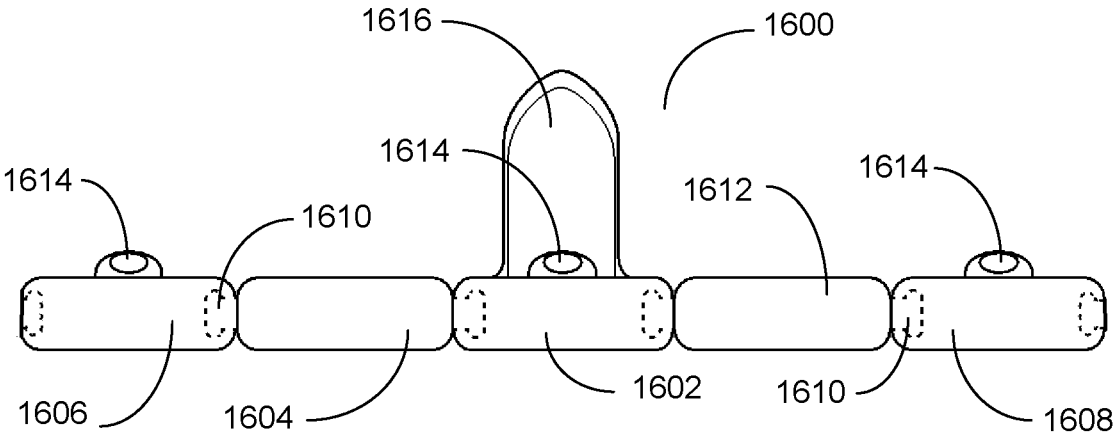
FIG. 16 is a top view of an interlocking hanger system for hanging pictures, mirrors and other objects on walls.

FIG. 16 is a top view of an interlocking hanger system for hanging pictures, mirrors and other objects on walls. The interlocking hanger system 1600 has a main hook member 1602. The first interlocking hook member 1602 is connected to a spacer 1604 that in turn connects to another interlocking hook member 1606. The interlocking hook members 1602, 1606 and 1608 are connected by a shape 1610 that allows the interlocking hanger members to interlock with the spacers 1604 and 1612. One or more nail holes 1614 may exist in each of the hook members 1602, 1606 and 1608. The hook 1616 could also be formed on hook members 1606 and 1608 for engaging with a wire or loop that is attached to a picture, mirror or object that a user wants to hang on a wall with the hanger and hook system.

While various embodiments of the invention have been described, it will be apparent to those of ordinary skill in the art that many more embodiments and implementations are possible that are within the scope of this invention.

What is claimed is:

1. A wall hanger, comprising:

a shaped member having a flat section and a hook section on one end of the shaped member;

a plurality of nail holes arranged in at least one vertical line on the shaped member allowing for adjustment in the vertical plane;

a first and second vertically oriented slot formed in a first and second sides of the shaped member such that the slot runs from a top of the first and second sides of the shaped member to the bottom of the shaped member;

a plurality of nail holes arranged in at least one horizontal line on the shaped member allowing for adjustment in the horizontal plane;

a spacer having a first interlocking shape along a left side and second interlocking shape along a right side of the spacer such that the first interlocking shape mates with the second slot in the first shaped member; and at least one nail having a screw cap for insertion into at least one of the plurality of holes in the at least one vertical line or the at least one horizontal line.

2. The wall hanger of claim 1, further comprising a raised area around the nail hole providing reinforcement of the hole.

3. A wall hanger, comprising:

a first shaped member having left and right sides, a flat section and a hook section on one end of the shaped member;

a plurality of nail holes arranged in a vertical line on the flat section of the first shaped member;

a slot formed in left and right sides of a second shaped member such that the slot runs from a top of the first and second sides of the second shaped member to the bottom of the second shaped member;

a T shaped protrusion on the left and right sides of the first shaped member for insertion into the slots in the left or right side of the second shaped member; and at least one nail having a screw cap for insertion into at least one of the plurality of holes.

4. The wall hanger of claim 3, further comprising a spacer having an interlocking shape on at least one side of the spacer that inserted into the slot in the side of the second shaped member.

5. A wall hanger, comprising:

a first shaped member having a flat section and a hook section on one end of the shaped member;

a plurality of nail holes arranged in a vertical line on the flat section of the first shaped member allowing for adjustment in the vertical plane;

a first and second vertically oriented slot formed in a first and second side of the first shaped member such that the slots run from a top of the first and second sides of the first shaped member to the bottom of the first shaped member;

a second shaped member having a flat section and a hook section on one end of the second shaped member;

a plurality of nail holes arranged in a vertical line on the flat section of the second shaped member allowing for adjustment in the vertical plane;

a third and fourth vertically oriented slot formed in a third and fourth side of the second shaped member such that the slots run from a top of the third and fourth sides of the second shaped member to the bottom of the second shaped member;

a spacer having a first interlocking shape along a left side and second interlocking shape along a right side of the spacer such that the first interlocking shape mates with the second slot in the first shaped member and the second interlocking shape mates with the third slot in the second shaped member; and at least one nail having a screw cap for insertion into at least one of the plurality of holes.

6. A wall hanger, comprising:

a shaped member having a flat section and a hook section on one end of the shaped member;

a plurality of nail holes arranged in at least one vertical line on the shaped member allowing for adjustment in the vertical plane;

a first and second vertically oriented slot formed in a first and second sides of the shaped member such that the slot runs from a top of the first and second sides of the shaped member to the bottom of the shaped member;

a plurality of nail holes arranged in at least one horizontal line on the shaped member allowing for adjustment in the horizontal plane and where the plurality of nail holes arranged in the vertical line intersect with the plurality of nail holes in the horizontal line forming a plus symbol a spacer having a first interlocking shape along a left side and second interlocking shape along a right side of the spacer such that the first interlocking shape mates with the slot in the shaped member; and at least one nail for insertion into at least one of the plurality of holes in the at least one vertical line or the at least one horizontal line.

7. The wall hanger of claim 6, further comprising a raised area around the nail hole providing reinforcement of the hole.

8. The wall hanger of claim 6, where the nail further comprises a shaft member and a screw cap.

* * * * *